United States Patent [19]

Noda

[11] 4,350,456

[45] Sep. 21, 1982

[54] PRINTER PROVIDED WITH A MARGIN SETTING MECHANISM

[75] Inventor: Atsushi Noda, Yokohama, Japan

[73] Assignee: Canon Kabushiki Kaisha, Tokyo, Japan

[21] Appl. No.: 102,788

[22] Filed: Dec. 12, 1979

[30] Foreign Application Priority Data

Dec. 21, 1978 [JP] Japan ..... 53/160478

[51] Int. Cl.[3] ..... B41J 21/02

[52] U.S. Cl. ..... 400/344; 400/320; 400/322; 400/351; 400/705.1

[58] Field of Search ..... 400/64, 320, 322, 323, 400/342, 344, 341, 351, 313, 317, 317.1, 686, 703, 705, 705.1, 706, 708, 903

[56] References Cited

U.S. PATENT DOCUMENTS

| | | | |
|---|---|---|---|
| 3,368,659 | 2/1968 | Mumpower | 400/686 X |
| 3,602,354 | 8/1971 | Theilen | 400/351 |
| 3,651,914 | 3/1972 | Locke | 400/344 X |
| 3,810,189 | 5/1974 | Casperson et al. | 400/320 X |
| 3,882,988 | 5/1975 | Sloan et al. | 400/317.1 |
| 3,981,383 | 9/1976 | Bittner et al. | 400/351 X |
| 3,988,744 | 10/1976 | Noda | 400/344 X |
| 4,024,447 | 5/1977 | Epstein | 400/320 X |
| 4,030,588 | 6/1977 | Hanagata et al. | 400/320 X |
| 4,044,882 | 8/1977 | Weinke et al. | 400/317.1 X |
| 4,203,678 | 5/1980 | Nordstrom et al. | 400/320 |

*Primary Examiner*—Ernest T. Wright, Jr.

*Attorney, Agent, or Firm*—Fitzpatrick, Cella, Harper & Scinto

[57] ABSTRACT

A printer provided with a margin setting mechanism is disclosed which has a printing head for writing information on a recording medium, a pulse motor for scan-driving the head, a detector for detecting the position of the head to put out a detection signal, and a control for receiving a phase signal applied to the pulse motor and the detection signal and putting out a signal to reverse the moving direction of the head when receiving both of said phase signal and detection signal.

5 Claims, 8 Drawing Figures

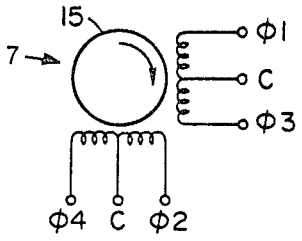
FIG. 4A
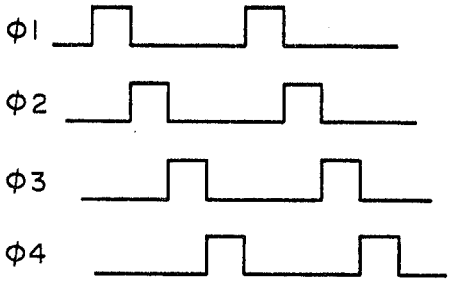
FIG. 4B
| DIGIT POSITION | 1 | 2 | 3 | 4 ····· | 2n-1 | 2n | 2n+1 |
|---|---|---|---|---|---|---|---|
| PHASE OF PULSE MOTOR | φ1 | φ2 φ3 φ4 | φ1 | φ2 φ3 φ4 ····· | φ1 | φ2 φ3 φ4 | φ1 |
| HEAD POSITION DETECTION AT LEFT MARGIN | O | | O | | O | | O |
| HEAD POSITION DETECTION AT RIGHT MARGIN | | O | | O | | O | |
FIG. 5
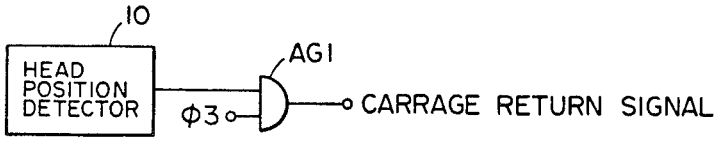
FIG. 6

PRINTER PROVIDED WITH A MARGIN SETTING MECHANISM

BACKGROUND OF THE INVENTION

1. Field of the Invention

The present invention relates to a printer provided with a margin setting mechanism for presetting the marginal line of printing area.

2. Description of the Prior Art

There is known a printer of the type in which a recording head is scanned to write information on a recording medium and which is provided with a margin setting mechanism. In such type of known printer, the control of margin setting is effected by detecting the position of the recording head. This necessitates an extremely precise and accurate detection mechanism.

SUMMARY OF THE INVENTION

Accordingly, it is an object of the invention to provide a printer provided with such margin setting mechanism which is easy to adjust after assembly even when the mechanism is composed of parts of relatively low preciseness and which enables one accurately to detect the position of the recording head.

Other objects and aspects of the invention will become apparent from the following description of embodiments with reference to the accompanying drawing.

BRIEF DESCRIPTION OF THE DRAWING

FIGS. 4A and 4B show the principle of a pulse motor;

FIG. 5 is a chart for explaining an embodiment of the invention; and

FIG. 6 is a diagram showing the signal line in the embodiment.

DESCRIPTION OF THE PREFERRED EMBODIMENT

Figure 1:
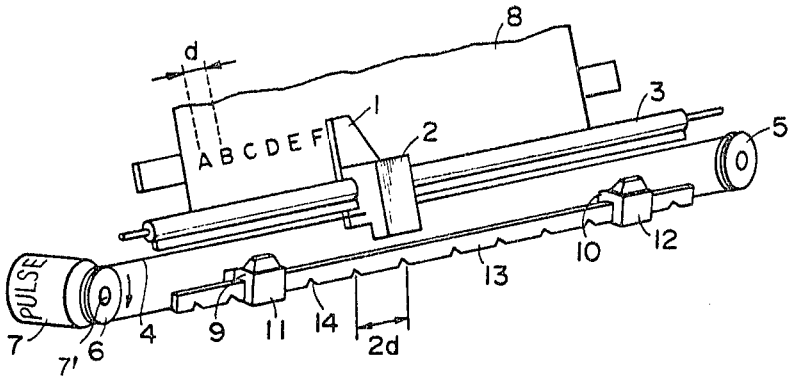
FIG. 1 is a perspective view of a printer with a margin setting mechanism showing an embodiment of the invention.

Referring first to FIG. 1, the printer shown therein has a printing head 1 mounted on a head carriage 2. The head carriage 2 is slide movable along a slide jig 3 and is connected with a pulse motor 7 through a wire 4, idle pulley 5 and driving pulley 6. With rotation of the pulse motor 7, the printing head 1 is moved along the slide jig 3 to effect printing on a recording paper 8.

Left and right margin setting carriages 11 and 12 carrying thereon left and right head position detectors 9 and 10 respectively constitute margin setting means. The margin setting carriages 11 and 12 are slide movable along a guide rail 13. To lock the margin setting carriages 11 and 12 at selected positions, the guide rail 13 has notches 14 disposed along the length of the rail 13 at intervals of every two print spaces or digits. Each of the margin setting carriages 11 and 12 has a biased roller (as shown in U.S. Pat. No. 3,988,744) which is engageable with any selected one of the notches 14 on the guide rail 13.

Figure 3A:
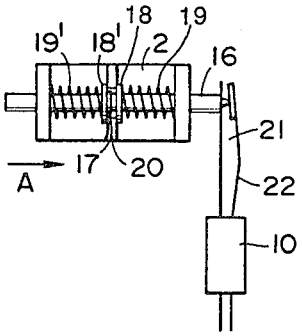
FIGS. 3A and B illustrate the manner of operation of the printing head and head position detector.

As detection means in the head position detectors 9 and 10 there may be used, for example, a contact type switch (as shown in FIG. 3A) such as a spring contact switch, microswitch and lead switch or a noncontact type switch such as a hall element switch and photocoupler.

The manner of operation of the printing head 1 and the head position detectors 9,10 is described with reference to FIGS. 2, 3A and 3B.

Figure 2:
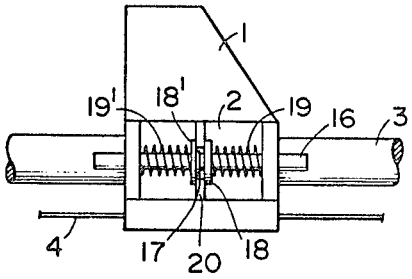
FIG. 2 is a detailed view of the printing head used therein.

In FIG. 2, reference numeral 16 designates a contact jig mounted on the head carriage 2 slide moveable in the axial direction of the slide jig 3.

Fixed to the contact jig 16 at the middle of its length is a clamp washer 17 sandwiched in between washers 18 and 18'. The washers 18 and 18' are movable along the contact jig 16 independently of the latter. On the contact jig 16 there are disposed also coil springs 19 and 19' which normally bias the washers 18 and 18' against a stopper 20 as shown in FIG. 2.

Figure 3B:
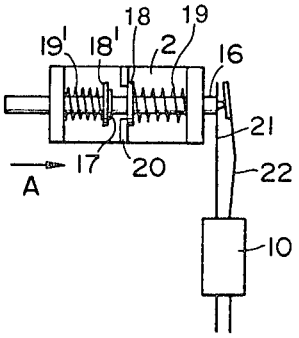

In the course of movement of the head carriage 2, for example, in the direction of arrow A in FIGS. 3A and 3B, the right side end of contact jig 16 comes into contact with the first plate spring contact 21 of the head position detector 10 at the right side margin and then pushes the first contact 21 against the second plate spring contact 22. Thereby the position of printing head 1 is detected. For this purpose, the spring force of the coil spring 19' has to be selected in such manner that it is stronger than that of the first spring contact 21 but is weaker than the sum of the spring force of the first spring contact 21 and that of the second spring contact 22.

A further movement of the head carriage 2 in the direction of arrow A up to the selected digit shifts the contact jig 16 inward, namely leftward relative to the head carriage 2. The right end of the contact jig 16 remains in contact with the spring contact 21 and therefore the contact between the two blade spring contacts 21 and 22 remains unchanged to continue the position detection of the printing head 1.

The above is applicable also to the detection of the head position at the left margin.

While the blade spring contact switch has been shown and described particularly in the embodiment as detection means, any other contact type switch also may be used in the same manner.

In the embodiment shown in FIG. 1, the pulse motor 7 used for driving the printing head 1 is a four phase (four step) pulse motor and the diameter of driving pulley 6 is so selected that a two step rotation of the pulse motor 7 causes the printing head 1 to move by one digit distance d. As previously mentioned, on the guide rail 13 there are provided notches 14 which are disposed at equal spaces of two digit distance 2d so that digit selection can be made every two digits.

The principle of the four phase pulse motor 7 will be described with reference to FIGS. 4A and 4B.

In FIG. 4A, the reference numeral 15 designates a rotor of a four phase pulse motor 7. By applying current to the phases $\phi 1$, $\phi 2$, $\phi 3$ and $\phi 4$ serially in this order, the rotor 15 is rotated forward and therefore the pulley 6 on the shaft 7' of the rotor 15 is rotated to move the printing head 1 forward, namely in the direction of printing. By applying current to the phases in the reversed order, that is, $\phi 4$, $\phi 3$, $\phi 2$ and $\phi 1$ serially, the rotor 15 is reversed to return the printing head 1 back to its starting position. As will be understood from the foregoing, by suitably adjusting the positions of pulse motor 7 and printing head 1 there can be obtained a 1 to 1 relation between the phases $\phi 1$–$\phi 4$ of pulse motor 7 and the positions of printing head 1 as shown in FIG. 5.

Assuming that the right head position detector 10 be set at an even-numbered digit, then the phase of pulse motor 7 will be always $\phi 3$ at the right margin position. Therefore, as seen from FIG. 6, a carriage return signal is derived from the logical product of the detection signal from the detector 10 and the phase signal $\phi 3$ from the pulse motor 7 at AND gate AG1. This carriage return signal is applied to a printer control circuit (not shown).

With the above described arrangement according to the invention, an allowance is given to the timing of the detection signal from the head position detector 10. For example, even when the detector 10 issues a detection signal some time before the arrival of the printing head 1 at the selected digit, for example, at the time point of phase $\phi 2$, it makes no trouble for obtaining a carriage return signal at good timing. A carriage return signal is produced only when the phase signal is turned to $\phi 3$ and the printing head 1 correctly reaches the selected position. This is the same for the head position detector 9 at the left margin.

In this manner, according to the invention, an accurate and precise detection of digit position is assured irrespective of some error in the detected position of printing head 1. In such instance of error there is no fear of the detection means being broken by the printing head 1. Therefore, parts for the margin setting mechanism used in the invention need not have so high preciseness as hitherto required. This makes it possible to provide an inexpensive margin setting mechanism which is easy to assemble and adjust.

While the present invention has been particularly shown and described with reference to a preferred embodiment thereof, it will be understood by those skilled in the art that the foregoing and other changes in form and details can be made therein without departing from the spirit and scope of the invention.

What I claim is:

1. A printer comprising:

a carriage provided with a recording head for writing information on a recording medium;

a projecting member mounted on said carriage and moveable thereon against the force of an elastic member;

driving means for causing said carriage to effect scanning movement, and detector means for controlling a writing position of said recording head on said carriage driven by said driving means, said detector means being operable upon contact by said projecting member.

2. A printer according to claim 1 wherein said projecting member is mounted on said carriage in such a way that said projecting member can move in the scanning directions of said carriage.

3. A printer according to claim 1 wherein said driving means comprises a pulse motor driven by a plurality of phase signals.

4. A printer according to claim 3 further comprising means for generating a carriage return signal by means of the combination of one of said phase signals and a detection signal from said detector means.

5. A printer according to claim 1 wherein said detector means has a switch operable by said projecting member.

* * * * *